United States Patent [19]

van der Heijden et al.

[11] Patent Number: 4,685,891

[45] Date of Patent: Aug. 11, 1987

[54] METHOD OF ASSEMBLING AN INTEGRATED ELECTRON GUN SYSTEM

[75] Inventors: Antonius W. F. van der Heijden; Petrus A. M. Fleuren, both of Eindhoven, Netherlands

[73] Assignee: U.S. Philips Corporation, New York, N.Y.

[21] Appl. No.: 9,119

[22] Filed: Jan. 29, 1987

Related U.S. Application Data

[63] Continuation of Ser. No. 710,649, Mar. 11, 1985, abandoned.

[30] Foreign Application Priority Data

Mar. 23, 1984 [NL] Netherlands ..... 8400927

[51] Int. Cl.[4] ..... H01J 9/18

[52] U.S. Cl. ..... 445/36

[58] Field of Search ..... 445/33, 34, 3, 66, 67; 269/47, 52; 29/467, 281.5, 283, 760

[56] References Cited

U.S. PATENT DOCUMENTS

| | | | |
|---|---|---|---|
| 2,721,374 | 10/1955 | Pilas | 29/760 X |
| 3,289,268 | 12/1966 | Bernardis | 445/66 |
| 3,417,458 | 12/1968 | Lob et al. | 269/52 X |
| 3,906,279 | 9/1975 | Linssen | 313/409 |
| 3,918,694 | 11/1975 | Laudick | 269/47 |
| 4,055,877 | 11/1977 | Hermans | 445/34 |
| 4,176,432 | 12/1979 | McCandless | 445/34 |
| 4,259,610 | 3/1981 | Takanashi et al. | 445/34 X |
| 4,499,402 | 2/1985 | van der Heijden | 445/34 X |

FOREIGN PATENT DOCUMENTS

| | | | |
|---|---|---|---|
| 15260 | 2/1977 | Japan | 445/66 |

*Primary Examiner*—Kenneth J. Ramsey

*Attorney, Agent, or Firm*—Robert J. Kraus

[57] ABSTRACT

Device for assembling an integrated electron gun system 5 for a color display tube of the "in-line" type which is composed of a number of electrodes centered around an axis. The device comprises a centering pins situated with their longitudinal axes substantially in one plane, on which the electrodes are positioned and are then fixed mechanically with respect to each other. If such a device comprises three centering pins (60, 61, 62) which, at least at the area of the apertures in the electrodes, have a substantially elongate perpendicular cross-section so that only selected parts (64, 65) of the centering pins contact the inner wall of the apertures in the electrode, the longitudinal axes of the cross-sections of the outermost pins being substantially perpendicular to the surface and the longitudinal axis of the cross-section of the central centering pin being substantially situated in the plane, the electrode can be positioned more accurately than with the device used up till now. If in addition at least two reference surfaces (67) and (73, 74) are used for the positioning of the electrodes in the axial direction, in which the location of the control grid, the first anode and the second anode is determined by a first reference surface (73, 74) and the location of the focusing lens electrodes is determined by a second reference surface, which first reference surface is determined by inwardly-stepped surfaces (73, 74) provided perpendicularly to the axes of the outermost centering pins, and the second reference surface (67) is formed on the base to which the centering pins are connected, it is possible to position the electrodes even more accurately with respect to each other as a result of which the spreading in the beam displacement is reduced by at least 50%.

4 Claims, 6 Drawing Figures

METHOD OF ASSEMBLING AN INTEGRATED ELECTRON GUN SYSTEM

This is a continuation of application Ser. No. 710,649 filed Mar. 11, 1985, abandoned.

BACKGROUND OF THE INVENTION

This invention relates to a device for assembling an integrated electron gun system for a color display tube of the "in-line" type which is composed of a number of electrodes centered around an axis. The device comprises centering pins situated with their longitudinal axes substantially in one plane, on which pins the electrodes are positioned and are then fixed mechanically with respect to each other.

The invention also relates to a method of assembling an integrated electron gun system for a color display tube of the "in-line" type by means of such a device.

A device for assembling an electron gun system which comprises three individual electron guns built up from electrodes is disclosed in U.S. Pat. No. 3,906,279. The device comprises a base on which three centering pins are connected. The axes of the pins are parallel to each other and are situated in one plane. The diameters of the pins becomes smaller stepwise towards the free ends of the pins. The electrodes are centered around the pins with the interposition of spacer plates which fix the spacings between the electrodes. The surface of the base is used as a reference surface. After positioning all the electrodes around the centering pins, the electrodes comprising connection braces are sealed in glass supporting rods by means of the braces. The three electron guns then form one assembly. The electron gun system is then slid from the centering pins.

An electron gun system of the integrated type for an "in-line" color display tube is described in Netherlands Patent Application No. 8203322, corresponding to U.S. patent application Ser. No. 516,016 filed July 22, 1983, and which may be considered to be incorporated herein by reference. In such an integrated electron gun system most gun electrodes are common to all the three electron guns. The common electrodes usually comprise a metal plate which has three apertures which may have collars and which serve to pass the three electron beams. The plate usually constitutes the bottom of a cup-shaped electrode component.

A device for assembling such an integrated electron gun system usually comprises two centering pins on which the outermost apertures of the electrodes are centered. The diameter of said centering pins depends on the tolerances of the diameter of the aperture in the electrode components to be assembled, the tolerances in the distance between the apertures in an electrode component and the desired play between the diameter of the aperture and centering pin diameter in behalf of the capability of detaching the assembled electron gun system from the centering pins.

The disadvantage of such a device for assembling the electron gun is that a number of alignment errors may be made such as centering errors of the apertures and obliguity errors of the lens components in which the apertures are provided. Such alignment errors are not permitted in electron gun systems in which a strong lens is introduced into the triode part. The triode part of an electron gun is the part comprising the cathode, the control grid and the first anode.

Such an electron gun system is disclosed in Netherlands Patent Application No. 8204185, corresponding to allowed U.S. patent application Ser. No. 544,169 filed Oct. 21, 1983, and which may be considered to be incorporated herein by reference. The result of such a strong lens is that the alignment errors result in comparatively large beam displacing errors (these are errors in the location and direction of the beam) as compared with known electron guns.

SUMMARY OF THE INVENTION

It is therefore an object of the invention to provide a device for assembling an integrated electron gun system for a color display tube of the "in-line" type in which the errors are considerably reduced.

For that purpose, a device of the type described in the opening paragraph is characterized according to the invention in that the device comprises three centering pins which have a substantially elongate cross-section at least at the area of the apertures in the electrode so that only selected portions of the centering pins contact the inner walls of the apertures in the electrode, the longitudinal axes of the cross-sections of the outermost pins being substantially perpendicular to the plane and the longitudinal axis of the cross-section of the central centering pin being situated substantially in the plane. By choosing a central centering pin oriented in the direction of the plane through the centering pins and two outermost centering pins oriented at right angles thereto, the longest diameter of the pins may be made larger than the diameter in the pins used so far because the diameter is independent of the tolerances in the distance between the apertures in the electrode components. Because only a comparatively small part of the centering pins is used for centering, the assembly of the electrodes is easier and the play between the wall of the apertures and centering pins for detaching the electron gun system after assembly may be smaller. Because the electrodes are positioned more accurately, a smaller beam displacing error will occur in electron guns assembled by means of the device according to the invention than in known guns.

A preferred form of a device according to the invention is characterized in that at least two reference surfaces are used for positioning of the electrodes in the axial direction, the location of the control grid, the first anode and the second anode being determined by a first reference surface and the location of the focusing lens electrodes being determined by a second reference surface. The first reference surface is determined by inwardly-stepped surfaces provided perpendicularly to the axis of the outermost centering pins, the second reference surface being formed on the base in which the centering pins are connected.

In the so far known assembly devices only one reference surface was used for the positioning in the axial direction. All the electrodes were arranged on the reference surface with the interposition of spacer plates. The disadvantage of this system is that all obliquity errors from the reference surface up to the control grid are added together, which results in comparatively large displacement errors. By using two reference surfaces, one for the triode part and one for the main focusing lens of the electron gun, the beam displacing errors are considerably reduced. By varying the second anode construction so that it consists of a first half and a second half, one half may be positioned on the first reference surface of the device and the other half on the second reference surface.

A preferred method of assembling an integrated electron gun system for a color display tube of the "in-line" type by means of a device according to the invention, which system comprises a control grid which is common to the three beams, a first anode, a second anode and a third anode, is characterized in that the second anode consists of two separate parts, the third anode and a part of the second anode are positioned on the second reference surface and on the centering pins with the interposition of a spacer plate, after which the second part of the second anode, the first anode and the control grid are positioned on the first reference surface and on the centering pins, after which all electrodes are mechanically fixed together by means of glass rods. An additional advantage of such a divided second anode is that heat transfer from the cathode to the second and third anodes is impeded. As a result of this beam displacements caused by thermal expansion of electrodes and connection braces and rods is reduced. It is also possible to apply a different potential to the two halves of the second anode with which the prefocusing and/or focusing can be influenced.

A reduction of the beam displacing spreading of 50% has taken measured as a result of using a device and/or method according to the invention.

BRIEF DESCRIPTION OF THE DRAWING

The invention will now be described in greater detail, by way of example, with reference to a drawing, in which.

DESCRIPTION OF THE PREFERRED EMBODIMENT

Figure 1:
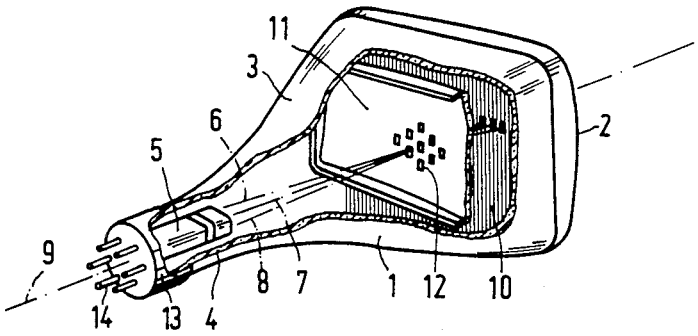
FIG. 1 is a perspective view of a color display tube of the "in-line" type.

FIG. 1 is a perspective view of a cathode ray tube according to the invention comprising a color display tube of the "in-line" type. In a glass envelope 1 which is composed of a display window 2, a cone 3 and a neck 4, an integrated electron gun system 5 is provided in the neck and generates three electron beams 6, 7 and 8 which prior to deflection, are situated with their axes in one plane. The axis of the central electron beam 7 coincides with the tube axis 9. The display window 2 comprises a large number of triplets of phosphor lines on its inside. Each triple comprises a line consisting of a blue-luminescing phosphor, a line consisting of a gree-luminescing phosphor, and a line consisting of a red-luminating phosphor. All triplets together constitute the display screen 10. The phosphor lines are substantially perpendicular to the plane through the beam axes. The shadow mask 11 positioned in front of the display screen includes a very large number of elongate apertures 12 through which each of the electron beams 6, 7 and 8 passes and impinges on phosphor lines of a respective color. The three electron beams situated in one plane are deflected by a system of deflection coils not shown. The tube has a tube base 13 with connection pins 14.

Figure 2:
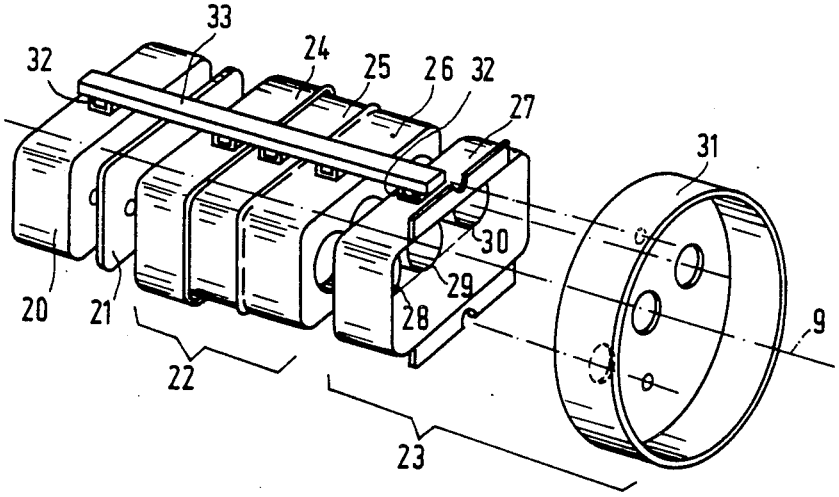
FIG. 2 is a perspective view of an electron gun system for the FIG. 1 tube.

FIG. 2 is a perspective exploded view of an embodiment of an electron gun system as used in the color display tube shown in FIG. 1. The electron gun system comprises a common cup-shaped control electrode 20 in which three cathodes (not visible) are connected, and a common plate-shaped first anode 21. The three electron beams situated with their axes in one plane are focused by means of the second anode 22 and third anode 23 which are common to the three electron beams. Anode 22 consists of three cup-shaped parts 24, 25 and 26. The parts 25 and 26 are connected together with their open ends. Part 25 is positioned coaxially in part 24 without any mechanical contact, (see also the parts 69 and 75 in FIG. 5). Anode 23 comprises one cup-shaped part 27 the bottom of which, like the bottoms of the other cup-shaped parts, is provided with apertures each being provided with three collars 28, 29 and 30. Anode 23 moreover comprises a centering sleeve 31 which is used for centering the electron gun system in the neck of the tube. The centering sleeve is for that purpose provided with centering springs, not shown. The electrodes of the electron gun system are connected in the conventional manner by means of braces 32 and glass rods 33.

Figure 3:
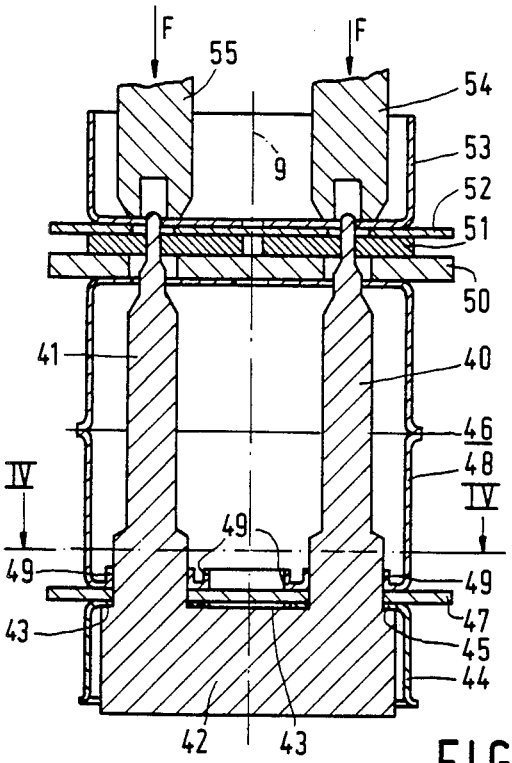
FIG. 3 PRIOR ART
FIG. 3 is a longitudinal sectional view of a prior art device.

FIG. 3 is a sectional view of a device used up till now for assembling integrated electron gun systems having positioned thereon components of an integrated electron gun. The device comprises a base 42 having two round centering pins 40 and 41. Because the diameters of the apertures in an integrated electron gun system decrease in the direction of the cathode, the centering pins have a stepped construction. The surface 43 of the base 42 serves as a reference surface for the positions of the electrodes of the electron gun system. A cup-shaped electrode 44 is placed on the base with its outermost apertures in the bottom 45 placed around the centering pins 40 and 41. A spacer plate 47 is provided between electrode 44 and electrode 46 which is composed of two cup-shaped parts connected against each other, which plate is removed after assembly. Electrode part 48 of electrode 46 has a bottom which compromises apertures around which collars 49 extend into the part. In the same manner the electrodes 51 and 53 are positioned around the centering pins 40 and 41 by means of spacer plates 50 and 52 with respect to the (reference) surface 43 of the base 42. All electrodes have assembly braces not shown which during the gun assembly are pressed in heated glass rods in the conventional manner. During assembly the electron gun system is pressed against the reference surface of the base by the pressure elements 54 and 55.

Figure 4:
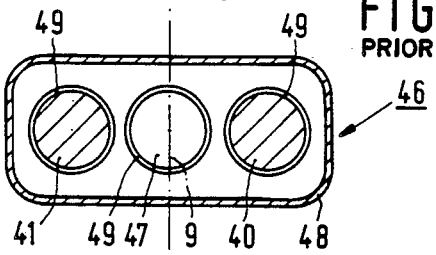
FIG. 4 PRIOR ART
FIG. 4 is a cross-sectional view of FIG. 3.

FIG. 4 is a sectional view of FIG. 3.

Figure 5:
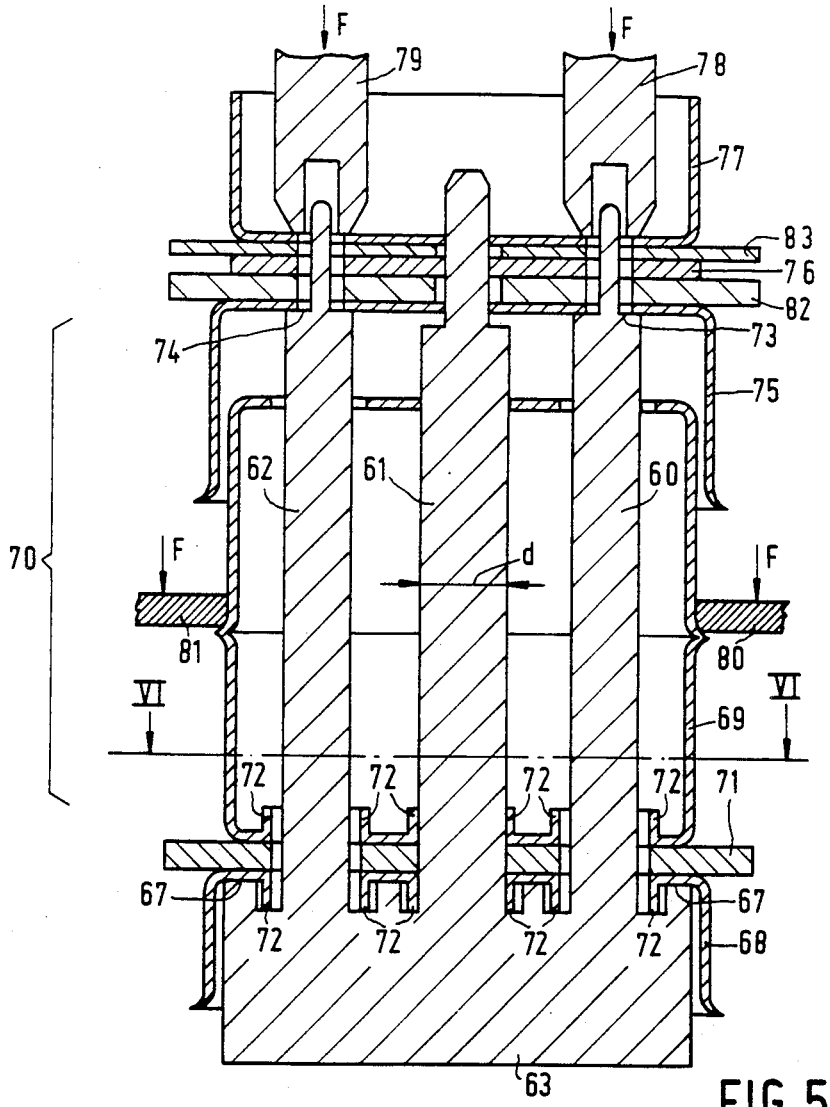
FIG. 5 is a longitudinal sectional view of a device according to the invention.
Figure 6:
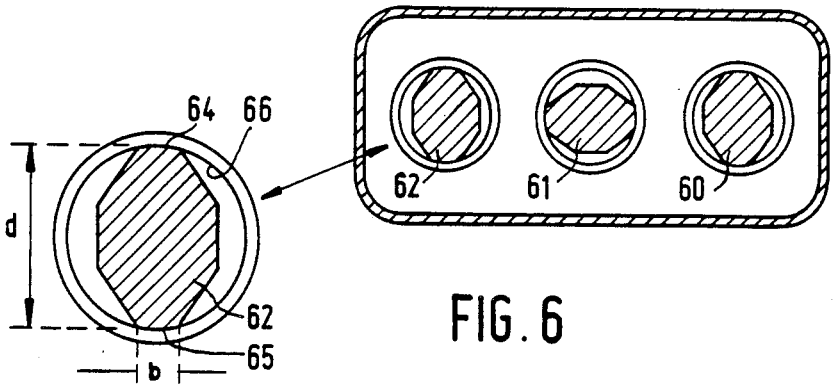
FIG. 6 is a sectional view of FIG. 5.

FIG. 5 is a longitudinal sectional view of a device according to the invention for the assembly of integrated electron gun systems. The components of an integrated electron gun system positioned on the device are shown again. The device comprises a base 63 having three centering pins 60, 61 and 52. The centering pins have an elongate perpendicular cross-section, as follows from FIG. 6. By making the cross-sections of the centering pins 60, 61 and 62 according to the invention elongate, the diameter d in the longitudinal direction of the cross-sections may be chosen to be larger than the diameters of the so far used centering pins 40, 41, because the diameter is independent of the tolerances in the distance between the apertures in the electrodes to be assembled. Because only a small part 64, 65 of the centering pins is used for centering, the assembly of the electrodes is easier and the play between the wall 66 of the apertures in the electrodes and the centering pins in behalf of detaching the electron gun system after assembly, may be smaller. The length b of the arcs 64 and 65 is, for example, 0.5 mm and at the area of the apertures in the electrodes 75, 76 and 77 it is, for example, 0.2 mm. The surface 67 of the base 63 forms a reference surface for positioning the third anode 68 and part 69 of the second anode 70. Another spacer plate 71 is provided between anode 68 and part 69. The apertures in the third anode 68 and part 69 of the second anode 70 comprise collars 72. The collars 72 of the third anode 68 fall in recesses in the base 63 around the centering pins 60, 61 and 62. The centering pins 60 and 62 comprise two inwardly-stepped surfaces 73 and 74 which together constitute the reference surface of the triode part. Part 75 of the second anode, the first anode 76 and the control grid 77 are centered, with the interposition of spacer plates 82 and 83, on the parts of the centering pins having a smaller cross-section extending away from the pins and having substantially the same shape as the remainder of the pins, and are positioned on the reference surface formed by the surfaces 73 and 74. During assembly the electrodes are pressed by pressure elements 78 and 79 against the reference surfaces. The third anode 68 and the second anode part 69 are urged against the reference surface 67 by means of pressure elements 80 and 81. It will be obvious that the elongate centering pins may also have an elongate cross-section other than the one shown. It is essential for the centering pins to have a limited contact surface with the apertures, and for the cross-section of the central centering pin to have a longitudinal axis which is situated in the plane through the longitudinal axis of the centering pins, and for the longitudinal axes of the cross-sections of the outermost centering pins to be perpendicular to the plane so that the centering functions of the central and outermost centering pins are uncoupled. It will be obvious that the number of reference surfaces for positioning the electrodes with respect to each other can even be made larger. This is suitable in electron gun systems having multistage focusing lenses and hence more electrodes which are to be positioned accurately with respect to each other. It will also be obvious that the centering pins may be provided with excentric parts to cause the aperture in two successive electrodes to be staggered with respect to each other. As is known, such staggered apertures enable electron beams to be subjected to a deflection or to provide an oblique electron lens.

What is claimed is:

1. A method for positioning relative to each other first and second pairs of spaced-apart electrodes of an integrated in-line electron gun for a color display tube, each electrode including a transversely-extending, plate-shaped part having central and first and second outer apertures for passing respective electron beams, each pair of electrodes including at least one cup-shaped electrode having its plate-shaped part symmetrically spaced from the corresponding plate-shaped part of the other electrode in the pair, said method comprising arranging the electrodes on an alignment device comprising a base from which extend central and first and second outer pins passing through respective ones of the electrode apertures, said pins having longitudinal axes lying in a common plane, characterized in that said electrodes are arranged on said device such that:

(a) the plate-shaped part of said cup-shaped electrode in the first pair is positioned on a first reference surface formed on an inwardly-stepped portion of at least one of the pins;

(b) the plate-shaped part of said cup-shaped electrode in the second pair is positioned on a second reference surface formed on the base from which the pins extend, thereby establishing a predetermined spacing between said cup-shaped electrodes; and (c) the spacing between the electrodes in each pair is established by inserting spacer means between the plate-shaped parts of said electrodes.

2. A method as in claim 1 characterized in that said electrodes are arranged on said device such that:

(a) each outer aperture surrounds a respective pin locally having an elongate cross-section with a maximum dimension in a direction transverse to the common plane which is substantially equal to the corresponding dimensions of said aperture; and (b) each central aperture surrounds a respective pin locally having an elongate cross-section with a maximum dimension substantially in said plane which is substantially equal to the corresponding dimension of said aperture.

3. A method for positioning relative to each other spaced-apart electrodes of an integrated in-line electron gun for a color display tube, said electrodes comprising a control grid, a first anode, a second anode including first and second discrete parts, and a third anode, each of said electrodes having central and first and second outer apertures for passing respective electron beams, said method comprising arranging the electrodes on an alignment device comprising a base from which extend central and first and second outer pins passing through respective ones of the electrode apertures, said pins having longitudinal axes lying in a common plane, characterized in that said method comprises the steps of:

(a) positioning on the base from which the pins extend a plate-shaped part of the third anode, said plate-shaped part being disposed against a reference surface on said base;

(b) positioning a first spacer against said plate-shaped part of the third anode;

(c) positioning against the first spacer a plate-shaped part of the first discrete part of the second anode;

(d) positioning against a reference surface formed on an inwardly-stepped portion of at least one of the pins a plate-shaped part of the second discrete part of the second anode, thereby establishing a predetermined spacing between the third anode and the second discrete part of the second anode;

(e) positioning a second spacer against the plate-shaped part of the second discrete part of the second anode;

(f) positioning against the second spacer a plate-shaped part of the first anode;

(g) positioning a third spacer against the plate-shaped part of the first anode; and (h) positioning against the third spacer a plate-shaped part of the control grid.

4. A method as in claim 3 characterized in that said electrodes are arranged on said device such that:

(a) each outer aperture surrounds a respective pin locally having an elongate cross-section with a maximum dimension in a direction transverse to the common plane which is substantially equal to the corresponding dimensions of said aperture; and (b) each central aperture surrounds a respective pin locally having an elongate cross-section with a maximum dimension substantially in said plane which is substantially equal to the corresponding dimension of said aperture.

* * * * *